US010588479B2

(12) United States Patent
Cho

(10) Patent No.: US 10,588,479 B2
(45) Date of Patent: Mar. 17, 2020

(54) CONTROL APPARATUS FOR WATER FLOW AND DISHWASHER HAVING THE SAME

(71) Applicant: LG ELECTRONICS INC., Seoul (KR)

(72) Inventor: Kichul Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 554 days.

(21) Appl. No.: 15/398,324

(22) Filed: Jan. 4, 2017

(65) Prior Publication Data

US 2017/0188784 A1 Jul. 6, 2017

(30) Foreign Application Priority Data

Jan. 5, 2016 (KR) ..... 10-2016-0000964

(51) Int. Cl.
*A47L 15/42* (2006.01)

(52) U.S. Cl.
CPC ..... *A47L 15/4223* (2013.01); *A47L 15/4217* (2013.01); *A47L 15/4244* (2013.01); *A47L 2501/04* (2013.01)

(58) Field of Classification Search
CPC ..... A47L 15/4217; A47L 15/4223; A47L 15/4244; A47L 2501/04
USPC ..... 134/56 D, 57 D, 58 D, 186
See application file for complete search history.

(56) References Cited

FOREIGN PATENT DOCUMENTS

| | | | |
|---|---|---|---|
| KR | 10-1998-0082395 | A | 12/1998 |
| KR | 10-0234100 | B1 | 12/1999 |
| KR | 10-0234106 | B1 | 12/1999 |
| KR | 10-0269473 | B1 | 12/2000 |
| KR | 10-2011-0130092 | A | 12/2011 |

OTHER PUBLICATIONS

International Search Report from PCT/KR2016/015575, dated Apr. 21, 2017.
Written Opinion of the ISA from PCT/KR2016/015575, dated Apr. 21, 2017.

*Primary Examiner* — Levon J Shahinian
(74) *Attorney, Agent, or Firm* — Dentons US LLP

(57) ABSTRACT

A control apparatus for a water flow is disclosed, which comprises an inlet connected to a water supply source; a discharge unit connected to a space where water is stored; a chamber for communicating the inlet with the discharge unit through a first communication unit connected to the inlet and a second communication unit connected to the discharge unit; a valve opening or closing the second communication unit; a first body fixed to any one of the inside of the inlet and the inside of the discharge unit; a first through hole provided to pass through the first body, forming a water flow; a second body fixed to the first body and located inside the first through hole; an elastic body fixed to the second body; a first support unit protruded from the first body to the elastic body, supporting the elastic body and forming a space between the elastic body and the first body to enter water the first through hole; and a second support unit protruded from the first body to the elastic body, selectively supporting the elastic body in accordance with a water pressure.

16 Claims, 5 Drawing Sheets

【Figure 1】
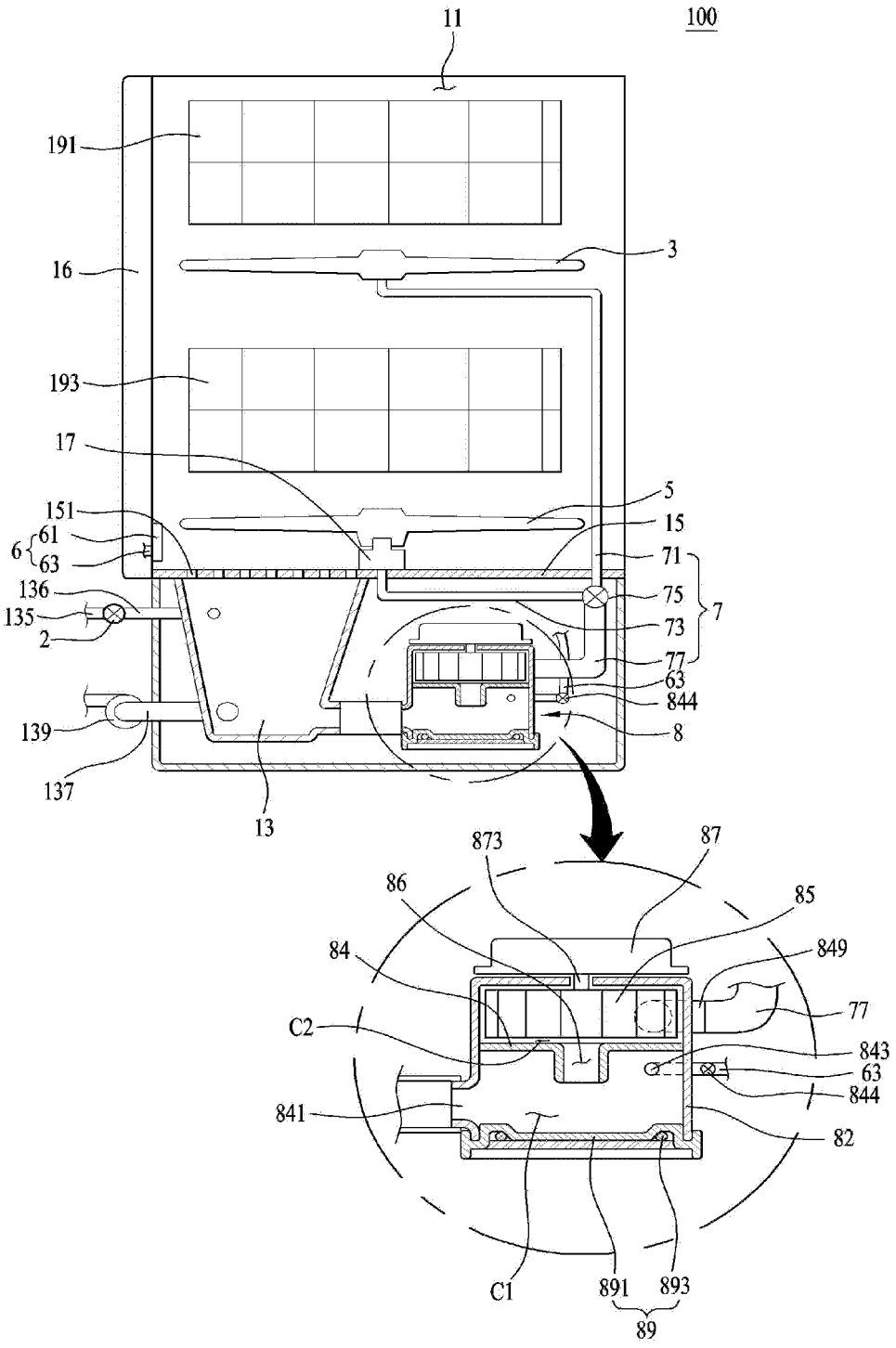

【Figure 2】
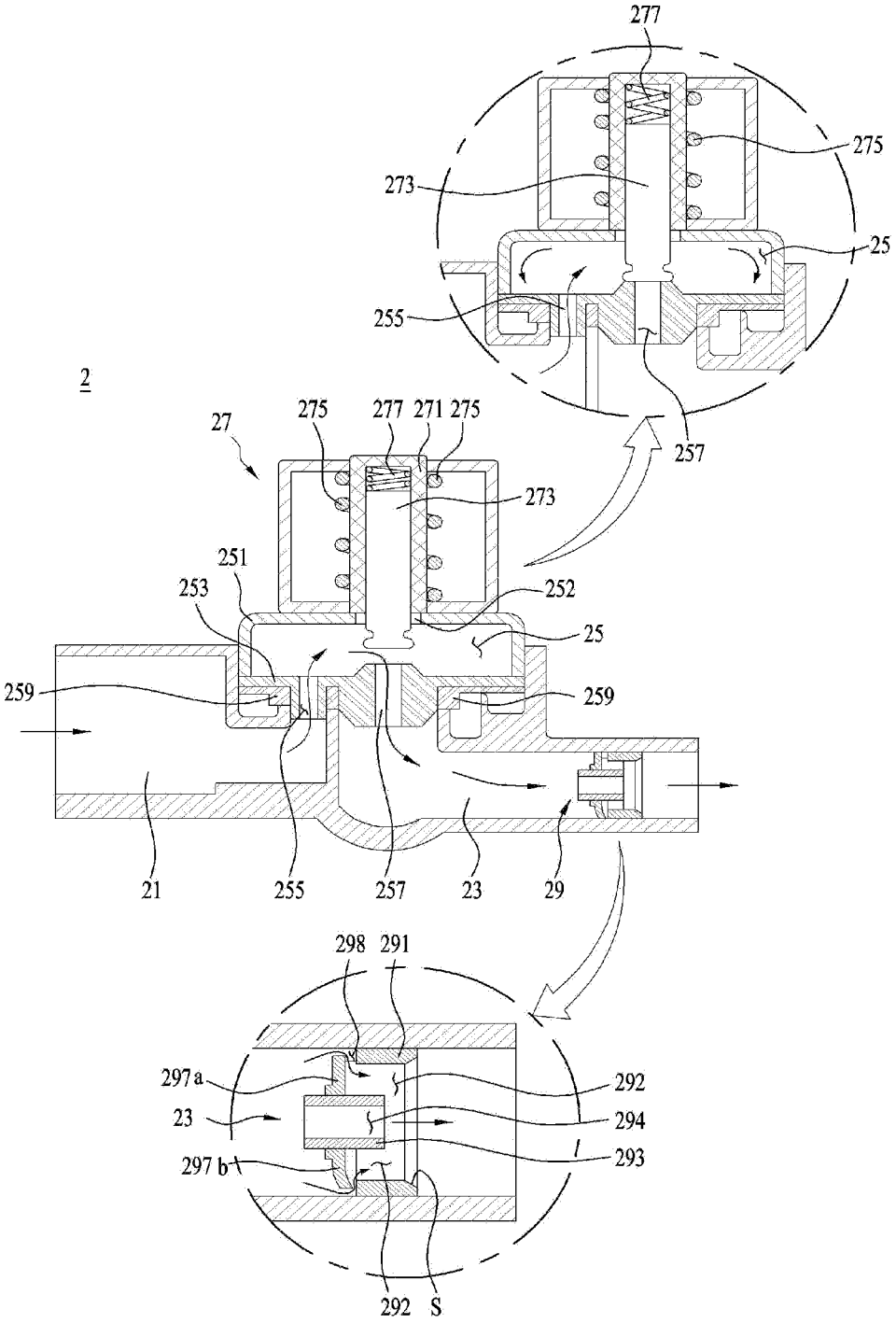

【Figure 3】
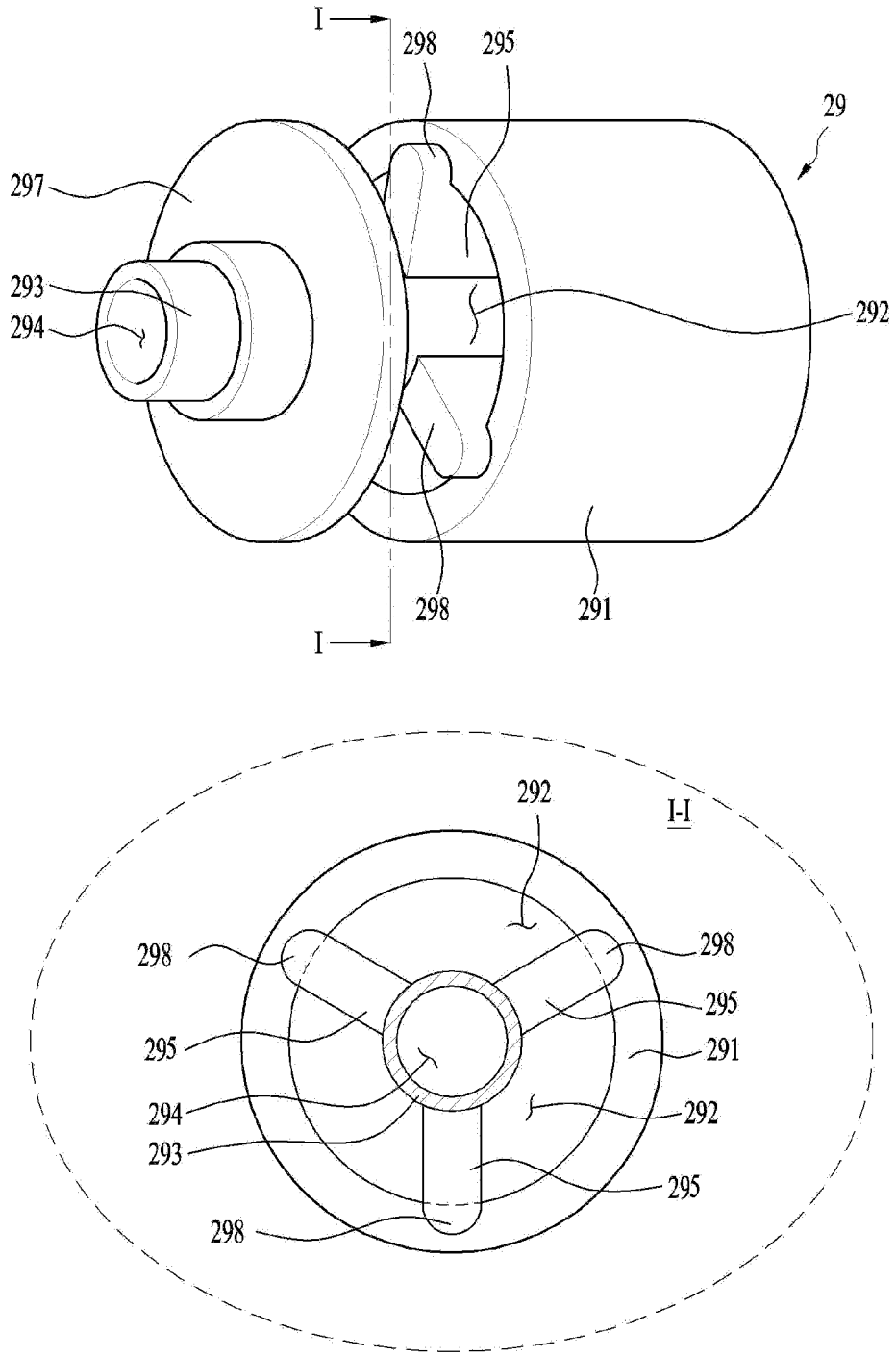

【Figure 4】
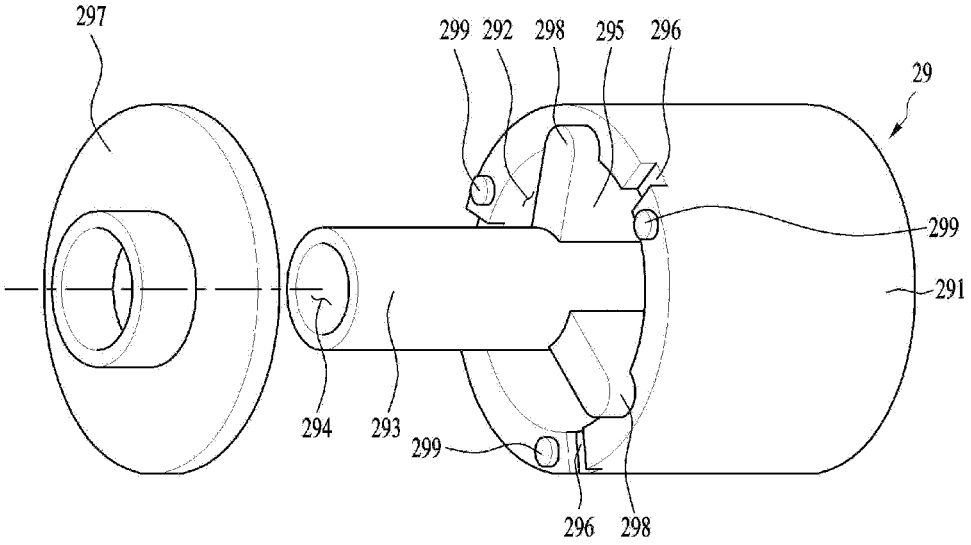
【Figure 5】
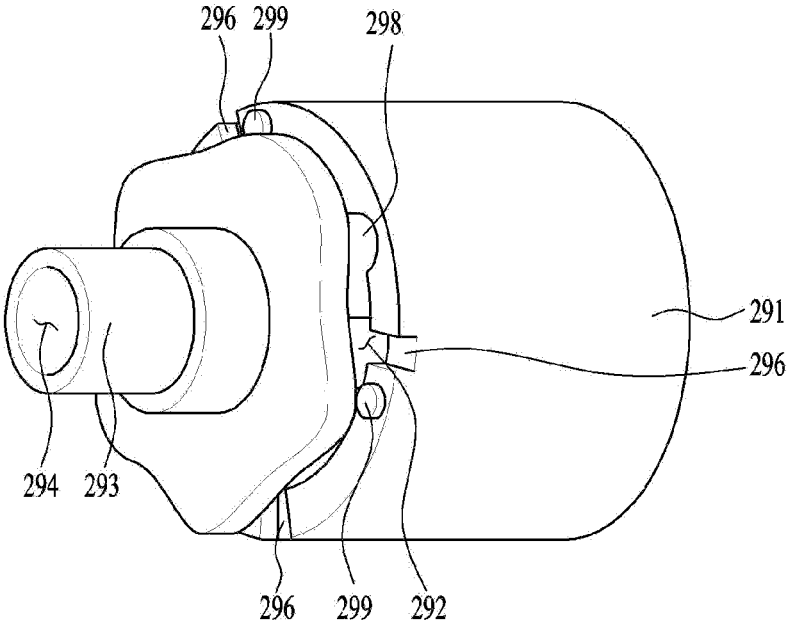

【Figure 6】
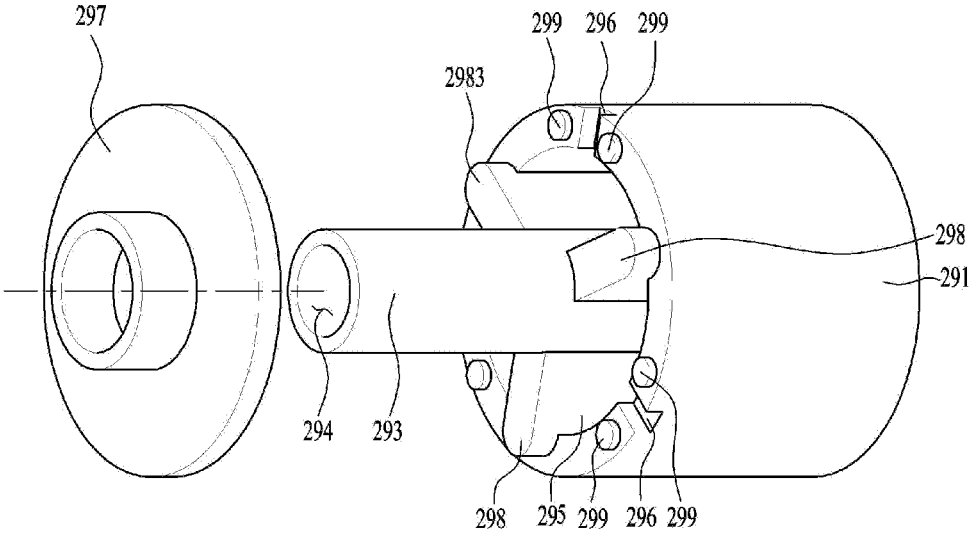

CONTROL APPARATUS FOR WATER FLOW AND DISHWASHER HAVING THE SAME

This application claims the benefit of the Korean Patent Application No. 10-2016-0000964, filed on Jan. 5, 2016, which is hereby incorporated by reference as if fully set forth herein.

BACKGROUND OF THE INVENTION

Field of the Invention

The present invention relates to a control apparatus for a water flow and a dishwasher having the same.

Discussion of the Related Art

A dishwasher is a home appliance that removes leftovers remaining on washing targets by spraying water to the washing targets.

It is general that a dishwasher of the related art includes a tub for providing a washing space, a spray arm for spraying water to the washing targets, a sump for storing the water therein, and a water flow controller provided in a water flow path for connecting a water supply source with the sump, controlling the amount of water supplied to the sump.

Meanwhile, noise may occur in the dishwasher of the related art when water is supplied to the sump. In the dishwasher having the aforementioned structure, it was not apparent that noise generated during water supply is caused by the structure of the water flow path or the structure of the water flow controller provided in the water flow path.

SUMMARY OF THE INVENTION

Accordingly, the present invention is directed to a control apparatus for a water flow and a dishwasher having the same, which substantially obviate one or more problems due to limitations and disadvantages of the related art.

An object of the present invention is to provide a control apparatus for a water flow, which attenuates noise generated during water supply.

Also, another object of the present invention is to provide a home appliance having a control apparatus for a water flow, which attenuates noise generated during water supply.

Other object of the present invention is to provide a control apparatus for a water flow, which may supply water of a certain amount to a space where water is stored, regardless of a pressure (speed of water) of water supplied from a water supply source, and a home appliance having the control apparatus for a water flow.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control apparatus for a water flow comprises an inlet connected to a water supply source; a discharge unit connected to a space where water is stored; a chamber for communicating the inlet with the discharge unit through a first communication unit connected to the inlet and a second communication unit connected to the discharge unit; a valve opening or closing the second communication unit; a first body fixed to any one of the inside of the inlet and the inside of the discharge unit; a first through hole provided to pass through the first body, forming a water flow; a second body fixed to the first body and located inside the first through hole; an elastic body fixed to the second body; a first support unit protruded from the first body to the elastic body, supporting the elastic body and forming a space between the elastic body and the first body to enter water the first through hole; and a second support unit protruded from the first body to the elastic body, selectively supporting the elastic body in accordance with a water pressure.

The control apparatus for a water flow according to the present invention may further comprise a bent portion located between the first support unit and the second support unit and provided as the first body is bent to be recessed toward a direction opposite to a direction that the first support unit is protruded.

The control apparatus for a water flow according to the present invention may further comprise a second through hole provided to pass through the second body, forming a water flow.

The control apparatus for a water flow according to the present invention may further comprise an inclined surface provided at one end of the first body to which water is discharge out, enlarging a diameter of the first through hole.

The first support unit may be provided as at least two protrusions spaced apart from each other as much as the same angle based on the second body, and the second support unit may be provided at least any one of spaces formed between the first support units.

The control apparatus for a water flow according to the present invention may further comprise a bent portion located at least any one of spaces formed between the first support unit and the second support unit and provided as the first body is bent to be recessed toward a direction opposite to a direction that the first support unit is protruded.

The control apparatus for a water flow according to the present invention may further comprise a bent portion provided as the first body is bent to be recessed toward a direction opposite to a direction that the first support unit is protruded, wherein the first support unit may be provided as at least two protrusions spaced apart from each other as much as the same angle based on the second body, the bent portion may be located at each space formed between the first support units, and the second support unit may be provided at each space formed between the bent portion and the first supports.

In another aspect of the present invention, a dishwasher comprises a tub providing a space where washing targets are received; a sump in which water is stored; spray arms spraying water to the washing targets; a pump supplying the water stored in the sump to the spray arms; a water supply path connected to a water supply source; a connection path connected to the sump; an inlet connected to the water supply path; a discharge unit connected to the connection path; a chamber for communicating the inlet with the discharge unit through a first communication unit connected to the inlet and a second communication unit connected to the discharge unit; a valve opening or closing the second communication unit; a first body fixed to any one of the inside of the inlet and the inside of the discharge unit; a first through hole provided to pass through the first body, forming a water flow; a second body fixed to the first body and located inside the first through hole; an elastic body fixed to the second body; a first support unit protruded from the first body to the elastic body, supporting the elastic body and forming a space between the elastic body and the first body to enter water the first through hole; and a second support unit protruded from the first body to the elastic body, selectively supporting the elastic body in accordance with a water pressure.

The dishwasher may further comprise a bent portion located between the first support unit and the second support unit and provided as the first body is bent to be recessed toward a direction opposite to a direction that the first support unit is protruded.

The dishwasher may further comprise a second through hole provided to pass through the second body, forming a water flow.

The dishwasher may further comprise an inclined surface provided at one end of the first body to which water is discharge out, enlarging a diameter of the first through hole.

The first support unit may be provided as at least two protrusions spaced apart from each other as much as the same angle based on the second body, and the second support unit may be provided at least any one of spaces formed between the first supports.

The dishwasher may further comprise a bent portion located at least any one of spaces formed between the first support unit and the second support unit and provided as the first body is bent to be recessed toward a direction opposite to a direction that the first support unit is protruded.

The dishwasher may further comprise a bent portion provided as the first body is bent to be recessed toward a direction opposite to a direction that the first support unit is protruded, wherein the first support unit may be provided as at least two protrusions spaced apart from each other as much as the same angle based on the second body, the bent portion may be located at each space formed between the first support units, and the second support unit may be provided at each space formed between the bent portion and the first supports.

According to the present invention, it is advantageous that a control apparatus for a water flow, which attenuates noise generated during water supply, is provided.

Also, according to the present invention, it is advantageous that a home appliance having a control apparatus for a water flow, which attenuates noise generated during water supply, is provided.

Also, according to the present invention, it is advantageous that a control apparatus for a water flow, which may supply water of a certain amount to a space where water is stored, regardless of a pressure (speed of water) of water supplied from a water supply source, and a home appliance having the control apparatus for a water flow are provided.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 illustrates an example of a home appliance having a control apparatus for a water flow according to the present invention;

FIG. 2 illustrates an example of a control apparatus for a water flow according to the present invention;

FIG. 3 illustrates an example of a flow rate controller provided in a control apparatus for a water flow;

FIGS. 4 and 5 illustrate another examples of a flow rate controller; and FIG. 6 illustrates other example of a flow rate controller.

DETAILED DESCRIPTION OF THE INVENTION

Reference will now be made in detail to the preferred embodiments of the present invention, examples of which are illustrated in the accompanying drawings. Meanwhile, it is to be understood that a configuration of an apparatus, which will be described hereinafter, or a method for controlling the same is not intended to restrict the scope of the present invention but intended to describe the embodiment of the present invention. Wherever possible, the same reference numbers will be used throughout the drawings to refer to the same or like parts.

The present invention relates to a control apparatus for a water flow, which is provided in a switching device for opening or closing a water flow path for connecting a water supply source with a space where water is stored, and minimizes noise generated when water is supplied through the water flow path. FIG. 1 illustrates that the control apparatus for a water flow is provided in a dishwasher as an example.

Although the control apparatus for a water flow according to the present invention may be provided in various home appliances other than a dishwasher, hereinafter, a case that the control apparatus for a water flow is provided in the dishwasher 100 will be described.

As shown in FIG. 1, the dishwasher 100 may include a cabinet 1, a tub 11 provided inside the cabinet 1, providing a washing space, spray arms 3 and 5 spraying water to washing targets, and a pump 8 for supplying water to the spray arms.

A rack for receiving washing targets may be provided inside the tub 11, and may include an upper rack 191 provided at an upper area of the tub and a lower rack 193 provided below the upper rack 191.

Since the tub 11 is opened or closed by a door 16 provided on one surface of the cabinet, a user may eject the racks 191 and 193 from the tub 11 after opening the tub 11 by using the door 16.

If the rack is provided with the upper rack 191 and the lower rack 193, the spray arms may be provided with an upper arm 3 for spraying water to the upper rack 191 and a lower arm 5 for spraying water to the lower rack 193.

The water (water remaining in the tub) sprayed from the spray arms 3 and 5 to the washing targets may return to the sump 13.

The sump 13 is a means provided below the tub 11, storing water, and may be identified from the tub 11 through a sump cover 15. In this case, the sump cover 15 may be provided with a returning hole 151 that communicates the inside of the tub 11 with the inside of the sump 13.

Meanwhile, the sump 13 is connected to a water supply source (not shown) through a water supply path 135 and a connection path 136, wherein the water supply path 135 connected to the water supply source and the connection path 136 connected to the sump 13 are selectively communicated with each other through a control apparatus 2 for a water flow.

The expression that the control apparatus 2 for a water flow selectively communicates the water supply path 135 with the connection path 136 means that the water supplied through the water supply path 135 may be supplied to the sump 13 through the connection path 136 or not, by the control apparatus 2 for a water flow. The water stored in the sump 13 is discharged to the outside of the dishwasher through a drainage path 137 and a drainage pump 139.

The water stored in the sump 13 is supplied to the spray arms 3 and 5 through a pump 8 and a supply path 7, wherein the supply path 7 may include a discharge path 77 connected to the pump 8, a first supply path 71 connecting the discharge path 77 with the upper arm 3, and a second supply path 73 connecting the discharge path with the lower arm 5.

The upper arm 3 may rotatably be coupled to the first supply path 71, and the lower arm 5 may rotatably be coupled to the second supply path 73.

The first supply path 71 and the second supply path 73 may be provided as the discharge path 77 is branched. In this case, a switching valve 75 for controlling switching of each supply path may be provided at a branch point of the first supply path 71 and the second supply path 73.

The pump 8 may include a pump body 82 fixed to the inside of the cabinet 1, a barrier 84 for forming a first pump chamber C1 and a second pump chamber C2 inside the pump body 82 by partitioning a space inside the pump body 82, a barrier through hole 86 provided at the barrier 84, communicating the first pump chamber C1 with the second pump chamber C2, and an impeller 85 provided inside the second pump chamber C2.

The first pump chamber C1 is connected with the sump 13 through a pump inlet 841 provided to pass through the pump body 82, and the second pump chamber C2 is connected with the discharge path 77 through a pump discharge unit 849 provided to pass through the pump body 82.

The impeller 85 is rotated by a motor 87 fixed to an upper surface of the pump body 82, and a rotational shaft 837 of the motor is connected to the impeller 85 by passing through the upper surface of the pump body 82.

Meanwhile, a heating unit 89 is provided on the bottom of the first pump chamber 1. If the pump body 82 is provided in an opened cylindrical shape, the heating unit 89 may be provided to form the bottom of the first pump chamber C1.

In this case, the heating unit 89 may be provided with a heating plate 891 forming the bottom of the first pump chamber C1, and a heater 893 fixed to the heating plate and located outside the first pump chamber C1. It is preferable that the heating plate 891 is made of metal to facilitate heat transfer.

Since the heating unit 89 is provided to form the bottom of the first pump chamber C1, the present invention may provide the pump 8 that may simultaneously perform a function of supplying water and a function of heating water.

Also, the dishwasher 100 provided with the aforementioned pump 8 may supply steam to the tub 11 through the heating unit 89. To this end, the dishwasher 100 may further include a steam supply unit 6.

The steam supply unit 6 may include a nozzle 61 for spraying steam to the inside of the tub 11, a steam supply pipe 63 for connecting the nozzle 61 with the first pump chamber C1, and a steam valve 65 for opening or closing the steam supply pipe.

FIG. 1 illustrates that the nozzle 61 is provided in the door 16 as an example. In this case, it is preferable that the nozzle 61 is fixed to a lower portion on one surface of the door, which forms a washing space.

Meanwhile, the dishwasher 100 having the aforementioned structure controls a timing for supplying water to the sump 13 through the control apparatus 2 for a water flow, which is provided between the water supply path 135 and the connection path 136.

As shown in FIG. 2, the control apparatus 2 for a water flow may include an inlet 21 connected to the water supply path 135, a discharge unit 23 to which the connection path 136 is connected, and a chamber 25 for connecting the inlet 21 with the discharge unit 23.

The inlet 21 and the discharge unit 23 may be provided in all shapes that can respectively be connected to the water supply path 135 and the connection path 136. FIG. 2 illustrates that the inlet 21 and the discharge unit 23 are provided in a pipe shape as an example.

The chamber 25 is communicated to the inlet 21 through a first communication unit 255, and is communicated to the discharge unit 23 through a second communication unit 257.

If the chamber 25 includes a second housing 253 forming the bottom and a first housing 251 fixed to an upper portion of the second housing 253, the first communication unit 255 and the second communication unit 257 may be provided to pass through the second housing 253.

Meanwhile, a sealing unit 259 for preventing water inside the chamber 25 from leaking out may further be provided on a contact surface between the second housing 253 and the inlet 21 and a contact surface between the second housing 253 and the discharge unit 23.

The control apparatus 2 for a water flow may further include a valve 27 for opening or closing the second communication unit 257. The valve 27 may include a guider 271 fixed to the first housing 251, a plunger 273 provided to be ejected from the guider 271, a spring 277 provided inside the guider 271, pressurizing the plunger 273 in a direction of the chamber 25, and a coil 275 moving the plunger 273 to the inside of the guider 271 depending on whether a current is supplied.

The guider 271 may be fixed to the first housing 251. In this case, one end of the plunger 273 may be located inside the guider 271, and a free end of the plunger 273 may be inserted into a housing through hole 252, which is provided to pass through the first housing 251, and then may be located inside the chamber 25.

At least a part of the plunger 273 is made of metal, and the coil 275 becomes an electromagnet if a current is supplied thereto through the controller. Therefore, if the current is not supplied to the coil 275, the free end of the plunger 273 closes the second communication unit 257 through the spring 277.

In this case, the second housing 253 is pressurized in a direction of the inlet 21 and the discharge unit 23 due to a pressure of water supplied into the chamber 25 through the inlet 21. If the second housing 253 is pressurized by the water pressure, the sealing unit 259 is compressed between the contact surface between the second housing 253 and the inlet 21 and between the contact surface between the second housing 253 and the discharge unit 23, and thus the water inside the chamber 25 is prevented from leaking out to the outside of the chamber 25.

Meanwhile, if the current is supplied to the coil 275, the plunger 273 will move toward the inside of the guider 271, whereby the free end of the plunger 273 will open the second communication unit 257. In this case, the water inside the chamber 25 will move to the discharge unit 23 through the second communication unit 257.

Although the control apparatus 2 having the aforementioned structure may determine whether to supply the water supplied from the water supply source to the sump 13, the control apparatus 2 has a difficulty in predicting the amount of the water supplied to the sump 13.

A dishwasher having no separate sensor for measuring a water level inside the sump 13 or a dishwasher provided in any one of the inlet 21 and the discharge unit 23, having no separate sensor for measuring the amount of water supplied to the sump 13 estimates the amount of water supplied to the sump 13 as the time when the valve 27 opens the second communication unit 257. If a water pressure of the water supplied from the water supply source is varied depending on a zone where the dishwasher 100 is built, a problem may occur in that it is difficult to exactly predict the amount of water supplied to the sump using the time when the valve 27 opens the second communication unit 257.

Meanwhile, in case of a dishwasher provided with a separate sensor for measuring a water level inside the sump 13 or a dishwasher provided in the discharge unit 23 or the like, having a separate sensor for measuring the amount of water supplied to the sump 13, if the water pressure of water supplied from the water supply source is high (if speed of the water is fast), a problem may occur in that an error is increased when the sensors measure a flow rate that passes through the inlet 21 or the discharge unit 23.

To solve the aforementioned problem, at least one of the inlet 21 and the discharge unit 23 is provided with a flow rate controller 29. FIG. 2 illustrates that the flow rate controller 29 is provided in the discharge unit 23 as an example. Hereinafter, for convenience of description, the flow rate controller 29 provided in the discharge unit 23 will be described.

The flow rate controller 29 provided in the present invention is a means that supplies water of a certain amount to the sump 13 by controlling a sectional area of the discharge unit 23 in accordance with a pressure of water supplied to the discharge unit 23.

As shown in FIG. 3, the flow rate controller 29 may include a first body 291 fixed to the inside of the discharge unit 23, a first through hole 292 provided to pass through the first body 291, forming a water flow, a second body 293 fixed to the first body 291 and located inside the first through hole 292, an elastic body 297 fixed to the second body 293, and a first support unit 298 protruded from the first body 291 to the elastic body 297, supporting the elastic body 297.

The first body 291 may be provided in all shapes that may be fixed to the inside of the discharge unit 23. If a sectional shape of the inside of the discharge unit 23 is a circular shape, the first body 291 may be provided to have a circular shaped section.

Since the first through hole 292 is provided inside the discharge unit 23 in parallel with a flow direction of water, the water discharged from the second communication unit 257 and then entering the discharge unit 23 may move toward the sump 13 through the first through hole 292.

The second body 293 may be fixed to the inside of the first through hole 292 through a fastening unit 295. The fastening unit 295 connects a circumferential surface of the second body 293 with the first through hole 292, and may be provided as a board provided along a direction parallel with a moving direction of the water that has passed through the inside of the first through hole 292. FIG. 3 illustrates that the fastening unit 295 is provided as three boards protruded radially from the circumferential surface of the second body 293 as an example.

The second body 293 may further be provided with a second through hole 294 provided to pass through the second body 293, forming a water flow. Preferably, the second through hole 294 is provided along a direction parallel with the moving direction of the water that has passed through the first through hole 292. The second through hole 294 is a means for minimizing decrease of the sectional area of the discharge area 23 through the flow rate controller 29.

The elastic body 297 may be provided in all materials and all shapes as far as its shape is varied depending on the water pressure inside the discharge unit 23. FIG. 3 illustrates that the elastic body 297 is made of a rubber, which is the same material as that of the first through hole 292, as an example.

Although the elastic body 297 is fixed to the second body 293, the elastic body 297 maintains a certain interval from the first body 291 through the first support unit 298. Therefore, the water inside the discharge unit 23 may move to the first through hole 292 through a space formed between the elastic body 297 and the first body 291.

The first support unit 298 may be provided in all positions of the first body 291 as far as the first support unit 298 may realize the aforementioned function. FIG. 3 illustrates that the first support unit 298 is provided as a protrusion protruded from the fastening unit 295 to the elastic body 297 and located outside the first through hole 292, as an example.

An operation procedure of the flow rate controller 29 having the aforementioned structure is as shown in FIG. 2.

If the aforementioned valve 27 opens the second communication unit 257, the water supplied from the water supply source enters the discharge unit 23 by passing through inlet 21, the chamber 25 and the second communication unit 257.

If the water enters the discharge unit 23, deformation of the elastic body 297 bent toward the first body 291 occurs due to the water pressure inside the discharge unit 23. However, an area 297*a* of the elastic body 292, which is supported by the first support unit 298, will not be deformed, whereas an area 297*b* of the elastic body 292, which is not supported by the first support body 298, will be deformed.

That is, the area 297*a* of the elastic body 292, which is supported by the first support unit 298, maintains a certain distance from the first body 291, whereas deformation occurs in that the area 297*b* of the elastic body 292, which is not supported by the first support body 298, is bent toward the first body 291.

Meanwhile, a deformation level of the area 297*b* of the elastic body 297, which is not supported by the first support unit 298, may be varied depending on the water pressure (speed of water moving along the discharge unit) inside the discharge unit 23. Therefore, the space formed between the elastic body 297 and the first body 291 when the water pressure inside the discharge unit 23 is low may be greater than the space formed between the elastic body and the first body when the water pressure inside the discharge unit is high.

If the space formed between the elastic body 297 and the first body 291 is great, water of a large amount may move to the sump 13 but speed of the water is low. If the space formed between the elastic body 297 and the first body 291 is small, water of a small amount may move to the sump 13 but speed of the water may be fast. As a result, the aforementioned flow rate controller 29 may supply water of a certain amount to the sump 13 regardless of the water pressure (speed of water moving along the inside of the discharge unit) inside the discharge unit 23.

Meanwhile, noise may occur in the control apparatus 2 having the aforementioned structure during water supply. This is because that noise and vibration may be caused due to shaking of the area 297*b* which is not supported by the first support unit 298 when the water enters the first through hole 292 through the space formed between the elastic body 297 and the first body 291.

To solve this problem, the flow rate controller 29 provided in the present invention may further include a second support unit protruded from the first body 291 to the elastic body 297, selectively supporting the elastic body 297 in accordance with the water pressure inside the discharge unit 23.

FIG. 4 illustrates an example of the flow rate controller 29 provided with the second support unit 299. The second support unit 299 provided in this embodiment is protruded from the first body 291 to the elastic body 297. The second support unit 299 may be provided to have the same height as that of the first support unit 298, or may be provided to have a height lower than that of the first support unit 298.

However, if the second support unit 299 is provided to have the same height as that of the first support unit 298, since deformation of the elastic body due to the water pressure is not great, it is not easy to perform the aforementioned function of the flow rate controller 29. Therefore, it is preferable that the second support unit 299 is provided to have a height lower than that of the first support unit 298.

Vibration of the elastic body area 297*b* which is not supported by the first support unit 298 is closely related with longitude of the elastic body 297. That is, the lower longitude of the elastic body is, the stronger vibration of the elastic body area 297*b* is. Therefore, if the elastic body 297 is made of a material having great longitude, the elastic body area 297*b* which is not supported by the first support unit may be minimized However, in this case, since deformation of the elastic body due to the water pressure is not great, a problem occurs in that it is difficult to perform the aforementioned function of the flow rate controller 29.

Meanwhile, when longitude of the elastic body is constant, vibration of the elastic body area 297*b* which is not supported by the first support unit may be reduced if the elastic body area 297*b* which is not supported by the first support unit has a shorter length (smaller area).

If the elastic body 297 is provided in a circular board shape, vibration of the elastic body 297 may be reduced if the elastic body area 297*b* which is not supported by the first support unit has a shorter circumferential length. Therefore, the second support unit 299 is a means that minimizes noise generated during vibration of the elastic body 297 by reducing a length of an area of the elastic body 297, where vibration may occur.

As shown in FIG. 4, if the first support unit 298 is provided as at least two protrusions spaced apart from each other at the same interval based on the second body 293, it is preferable that the second support unit 299 is provided at a space between one first support unit 298 and another first support unit 298.

In this case, the second support unit 299 may be provided at only a part of the spaces formed between the first support units 298, or may be provided at each of the spaces formed between the first support units 298.

Meanwhile, as shown in FIG. 5, if the second support unit 299 is provided in the first body 291, since a water flow of the water entering the first through hole 292 may be reduced, a bent portion 296 bent to be recessed toward a direction far away from the elastic body 297 may further be provided in the first body 291.

In this case, the bent portion 296 may be provided at a part of spaces formed between the first support unit 298 and the second support unit 299, or may be provided at each of the spaces formed between the first support unit 298 and the second support unit 299.

Meanwhile, the flow rate controller 29 of the present invention may be provided as shown in FIG. 6.

The flow rate controller 29 shown in FIG. 6 is characterized in that the second support unit 299 is provided at both sides of the bent portion 296. The flow rate controller 29 of FIG. 6 may attenuate vibration of the elastic body 297 less and less because the number of second support units 299 of FIG. 6 is more than those of FIG. 4.

That is, if the first support unit 298 is provided as at least two protrusions spaced apart from each other at the same interval based on the second body 293, the bent portion 299 may be provided at each space between one first support unit 298 and another first support unit 298, and the second support unit 299 may be formed at each space formed between each bent portion 296 and each first support unit 298.

Therefore, the present invention may provide the control apparatus for a water flow, which may minimize noise, of which occurrence cause was not apparent in the related art home appliance, during water supply, and a home appliance having the same, wherein the noise Moreover, to minimize noise generated during water supply, the control apparatus 2 for a water flow may further include an inclined surface S that enlarges a diameter of the first through hole 292.

As shown in FIG. 2, the inclined surface S may be provided at one end of the first body 291, to which water is discharged out. Vortex is formed at the rear of the first body 291 in accordance with a shape of the first body 291 to which water is discharged out. If the inclined surface S, which enlarges the diameter of the first through hole 292, is provided at one end of the first body 291, to which water is discharged out, occurrence of vortex may be minimized and thus noise may be attenuated.

Although the aforementioned description has been described based on the case that the control apparatus 2 for a water flow according to the present invention is provided in the dishwasher, the control apparatus 2 for a water flow may be applied to a home appliance, such as a dryer, which needs supply of cooling water for cooling the air heat-exchanged with clothes.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A water flow control apparatus, comprising:

an inlet connected to a water supply source;

a discharge unit connected to a water storage;

a chamber for communicating the inlet with the discharge unit through a first communication unit connected to the inlet and a second communication unit connected to the discharge unit;

a valve for opening/closing the second communication unit;

a first body fixed to one of an inside of the inlet or an inside of the discharge unit;

a first through hole passing through the first body and configured to form a water flow;

a second body located inside the first through hole;

an elastic body coupled to the second body;

a first support unit protruded from the first body to the elastic body, supporting the elastic body and forming a space between the elastic body and the first body; and a second support unit protruded from the first body to the elastic body, selectively supporting the elastic body based on water pressure.

2. The control apparatus of claim 1, further comprising:

a bent portion located between the first support unit and the second support unit.

3. The control apparatus of claim 2, wherein the bent portion is provided as the first body is bent to be recessed in an opposite direction from that which the first support unit is protruded.

4. The control apparatus of claim 1, further comprising:

a second through hole passing through the second body and configured to form an additional water flow.

5. The control apparatus of claim 1, further comprising:

an inclined surface at the end of the first body where water is discharged out, the inclined surface enlarging a diameter of the first through hole.

6. The control apparatus of claim 1, wherein the first support unit comprises at least two protrusions equally spaced apart from each other around the second body, and wherein the second support unit is provided in at least one space formed between the first support units.

7. The control apparatus of claim 6, further comprising:

a bent portion located at least at one space formed between the first support unit and the second support unit.

8. The control apparatus of claim 1, further comprising:

a bent portion provided as the first body is bent opposite to a direction that the first support unit is protruded, wherein the first support unit comprises at least two protrusions equally spaced apart from each other around the second body, and wherein the bent portion is located at each space formed between the first support units, and the second support unit is provided at each space formed between the bent portion and the first supports.

9. The control apparatus of claim 1, wherein the second body is fixed to the first body.

10. The control apparatus of claim 1, wherein the space formed between the elastic body and the first body allows water to enter the first through hole.

11. A dishwasher comprising:

a tub for receiving washing targets;

a sump in which water is stored;

spray arms spraying water to the washing targets;

a pump supplying the water stored in the sump to the spray arms;

a water supply path connected to a water supply source;

a connection path connected to the sump;

an inlet connected to the water supply path;

a discharge unit connected to the connection path;

a chamber for communicating the inlet with the discharge unit through a first communication unit connected to the inlet and a second communication unit connected to the discharge unit;

a valve for opening/closing the second communication unit;

a first body fixed to one of an inside of the inlet or an inside of the discharge unit;

a first through hole passing through the first body and configured to form a water flow;

a second body located inside the first through hole;

an elastic body coupled to the second body;

a first support unit protruded from the first body to the elastic body, supporting the elastic body and forming a space between the elastic body and the first body; and a second support unit protruded from the first body to the elastic body, selectively supporting the elastic body based on water pressure.

12. The dishwasher of claim 11, wherein the first support unit comprises at least two protrusions equally spaced apart from each other around the second body, and wherein the second support unit is provided in at least one space formed between the first supports.

13. The dishwasher of claim 12, further comprising:

a bent portion located at least at one space formed between the first support unit and the second support unit.

14. The dishwasher of claim 11, further comprising:

a bent portion provided as the first body is bent opposite to a direction that the first support unit is protruded, wherein the first support unit comprises at least two protrusions equally spaced apart from each other around the second body, and wherein the bent portion is located at each space formed between the first support units, and the second support unit is provided at each space formed between the bent portion and the first supports.

15. The dishwasher of claim 11, wherein the second body is fixed to the first body.

16. The dishwasher of claim 11, wherein the space formed between the elastic body and the first body allows water to enter the first through hole.

* * * * *